United States Patent [19]

Sugimoto

[11] 4,255,121

[45] Mar. 10, 1981

[54] GASEOUS FUEL CONTAINING WATER, APPARATUS THEREFOR

[75] Inventor: Takeshige Sugimoto, Tosayama, Japan

[73] Assignee: Eces Co. Ltd., Kochi, Japan

[21] Appl. No.: 933,576

[22] Filed: Aug. 14, 1978

[51] Int. Cl.[3] ..... F23D 11/44

[52] U.S. Cl. ..... 431/208; 431/210; 48/180 C; 48/180 H; 48/180 S; 239/135; 239/466

[58] Field of Search ..... 431/209, 208, 210, 4, 431/9, 264; 48/180 C, 180 H, 180 S, 196 A; 60/39.71, 39.82 C, 39.64 A; 44/51; 239/135, 402, 466; 123/25 R, 25 A

[56] References Cited

U.S. PATENT DOCUMENTS

| | | | |
|---|---|---|---|
| 970,349 | 9/1910 | Owin | 48/180 H |
| 1,242,975 | 10/1917 | Planche | 48/180 H |
| 1,474,900 | 11/1923 | Goldsmith | 239/402 |
| 1,557,261 | 10/1925 | McCarthy | 48/180 S |
| 3,034,726 | 5/1962 | Péras | 234/132 |
| 3,932,567 | 1/1976 | Skidmore | 48/180 S |
| 4,076,002 | 2/1978 | Mellqvist et al. | 123/25 R |

*Primary Examiner*—Samuel Scott
*Assistant Examiner*—Lee E. Barrett
*Attorney, Agent, or Firm*—Wenderoth, Lind & Ponack

[57] ABSTRACT

This invention is directed to a gaseous fuel containing water produced by a process, wherein a mixture gas of water, fuel and air is swirled with intense friction between them, contacted with metallic elements to receive thermoelectrons and activated at a temperature about 100°-600° C., as well as a process and apparatus for producing said fuel. When the gaseous fuel containing water by this invention is burned, the calorific value is greater than that of pure fuel combustion and the discharge of $NO_x$ and CO from the exhaust gas is small.

3 Claims, 13 Drawing Figures

GASEOUS FUEL CONTAINING WATER, APPARATUS THEREFOR

The present invention relates to a gaseous fuel containing water which has a high efficiency of combustion, a high calorific value and which is not pollutive to the atmosphere. This fuel gas is produced by a process wherein a mixture of water and fuel oil or fuel such as LP-gas etc. or both is vaporized in the presence of the air and activated, and a process and an apparatus for producing it.

As for the methods, up to the present time, for improving the efficiency of the combustion of fuel containing water, there has been proposed a process wherein fuel oil and water are emulsified by the action of surface-active agents or ultrasonic waves and burned directly, or a process wherein an atomized mixture of the gaseous fuel and water is led to a furnace and burned. By the former method, however, a complicated apparatus is required in order to supply the emulsion of fuel oil and water to the furnace in a stable steady-state, furthermore, high combustion efficiency can not be attained as expected and thus gaseous fuel can not be used. On the other hand, the latter method has defects in that it is difficult to make a homogeneous and perfect mixture of the mist of fuel and water, and both the combustion efficiency and combustion temperature are lower as compared to a pure fuel combustion due to the drain in the furnace.

An object of this invention is to provide a water-fuel-air mixture gas at a temperature of about 100°-600° C. in an excited state for utilizing the water as a fuel by a process wherein a water and fuel mixture is vaporized in the presence of the air, swirled violently with intense friction between the gas particles and activated by contacting the gaseous mixture with heated metal plates. The air supply required to burn the gaseous water-fuel-air mixture by this invention is more than that required for the case of pure fuel combustion by 10% considering the air ratio, so the combustion efficiency can be remarkably improved compared to the conventional method, and the heating power i.e., the calorific value is increased. When the mixture gas by this invention is burned a flame showing a colza-color is produced and the temperature of the flame is much higher than that required for the combustion of pure fuel. Further, the volume of the flame is larger and the humidity of the waste gas is the same or less than that produced in the combustion of pure fuel. On the other hand, the temperature of the waste gas in the present invention is the same or higher than that of pure fuel combustion. Thus, the gas mixture of this invention is a new kind of fuel making it possible to burn water with the fuel under the above-mentioned conditions. The fuel produced by the process of the present invention is characterized by a higher calorific value and combustion efficiency than fuel produced by conventional methods. Furthermore, higher temperatures as well as a higher fuel volume can be utilized by the present process. Therefore, the fuel and method can be used in a combustion apparatus of varying designs, etc.

Generally, water is a colorless, transparent and odorless liquid and consists of a molecule ($H_2O$) which is composed of hydrogen and oxygen atoms bonded to each other. When the water is heated, heat is transferred locally and convective motion is generated due to the temperature difference. 637 calories is required per 1 cc of water to raise the temperature of water from 0° C. to 100° C. steam. It is easy to vaporize the water by atomizing at reduced pressure, although a large amount of energy is required to vaporize water. Mist of water, however, easily returns to a liquid phase, but the mist is transformed to a vapor in an extremely short time if contacted with a heated metal, such vaporization occuring instantaneously, and never returns to the liquid phase. In this invention, the water and the fuel are vaporized, respectively, mixed and activated.

Vaporized water and fuel are easy to activate. Therefore, activation energy is imparted to the water-fuel gaseous mixture in order to decompose each molecule, and change the molecules into an activated state, wherein the reaction between them easily takes place, and also into an excited state, wherein the structure of each molecule is changed. Since the heated metal releases a large number of thermoelectrons, the water-fuel mixture gas is easily activated when contacted with said heated metal. For example, if a water fuel gaseous mixture is contacted with a heated activation catalyst, which is prone to take place, hydration or a partial oxidation of the hydrocarbons in the fuel occurs and activation of the said gaseous mixture is accelerated by the activation of the thermoelectrons from the catalytic metal. In other words, it is supposed that in the presence of the activation catalytic metal, the water-fuel mixture gas is in a state, wherein hydration or a partial-oxidation reaction with the hydrocarbon easily takes place, but it is not clear whether these reaction really take place or not in the presence of the air per se. In addition, if the water-fuel mixture gas is swirled violently together with the air, reaction among the molecules takes place easily due to the increased friction between the various water and fuel particles. In addition to the above-mentioned swirling motion, the repeated expansion and compression of the gaseous mixture with the increase and decrease in pressure, intensifies the frictional motion. In the above-mentioned process of increasing the frictional motion between the molecules decomposition of the molecular bond is accelerated and reaction between atoms easily takes place due to the excitation of the molecular-bond ions by the thermoelectrons.

Furthermore, when the water and the fuel are heated up to temperatures of 100°-600° C., preferably 160°-200° C., in particular 180° C., wherein the specific heat of the water is not different from that of the fuel, the reaction between water and fuel particles is greatly facilitated because they both have the same specific heat value. Namely, at first the liquid changes to gas, and then, macromolecules of the gas is gradually subdivided into simple molecules. The simple molecule consists of atoms, which is thought to be combined by the electric action produced by the aforementioned process. It is supposed that the activation of the molecules are intentified by the thermal energy of heating and the frictional energy produced by the swirling motion, and when the activation of the molecules reach a certain limit, the electric bond-forces are saturated and electrons existing between the molecules move more actively, and finally the molecules are decomposed when the thermoelectrons from the activation catalyst, consisting of the externally heated metallic plate, attack and excite them. This invention is designed so that both the water and the fuel are vaporized and heated in the presence of the air up to a temperature wherein they are easily activated, and that the gaseous mixture is swirled and pressure changes are applied to it with intense friction so that the gas molecules are in a state of activation. Simultaneously the gas molecules are contacted with the heated metal so as to be excited by the thermoelectrons produced by the heated metal. As a result, the water and the fuel are decomposed in the presence of the air and high level energy is generated by causing a new phenomena to occur in the gaseous molecule, which has never been experienced up to the time of the present invention.

According to the present invention a new and improved gaseous fuel containing water has been created, which fuel is produced by a process wherein a gaseous mixture of water, fuel and air is swirled so as to generate intense friction between them, the gas is contacted with the metallic elements heated to a temperature of about 100°-600° C. as an activation catalyst to impart thermoelectrons to the gas and activate it.

The invention also relates to an apparatus for producing the gaseous fuel containing water. More particularly, this invention relates to a novel apparatus for carrying out the above-mentioned process including a means of supplying the gaseous mixture of water, fuel and air, a reaction passage wherein the gaseous mixture is led towards one direction and swirled so as to create intense friction between the gases, a means of heating the gaseous mixture gas in the said passage up to a temperature about 100°-600° C., and metallic elements as an activation catalyst to contact the gaseous mixture gas in the said passage and give off thermoelectrons.

As a preferred embodiment of an apparatus according to the present invention, is provided a combustion apparatus for the gaseous fuel containing water, said apparatus itself forming a cylinder wherein from a supply end to an outlet, which is open at one end; a series of swirl flow means is generated about an axis; a pump is used, which feeds compressed primary-air from the supply end of the apparatus through a nozzle; a supply device consisted of a nozzle which injects and atomizes the water and the fuel liquid or mixtures thereof into the apparatus by means of blowing the said primary air into said apparatus; a heating device which heats and vaporizes the mist produced by atomizing the water and fuel liquid or the mixtures thereof by the primary-air; a means, including at least more than 2 nozzles, of repeatingly increasing and decreasing the pressure and swirling the vapor, produced by vaporizing the water and the fuel liquid or the mixture by the primary-air along the axis of the said container; metallic elements which contact with and activate the said vapor in order to cause a reaction to take place between the water, the fuel and the air; a means of intake of secondary-air, which supplies the compressed secondary-air to the outlet of the said container and mixes the secondary-air with the said reactive gases, and forcedly blows out the said gaseous mixture from the outlet of the said container, and ignition means to burn out the mixture of the reactive gas and the secondary-air near the outlet of the said apparatus.

When the gaseous fuel containing water according to the present invention is burned, the calorific value is greater than that of pure fuel combustion and the discharge of $NO_x$ and CO from the exhaust gas is small. This is confirmed using experimental data by an apparatus shown in the following example.

The water, fuel and air used in this invention need not be in a particular state. In other words, the materials may contain some impurities and be in a solid, liquid or gaseous phase. As a fuel, for example, heavy oil or propane-gas may admittedly satisfy the objects of this invention. The metallic element used in the apparatus of this invention consists of a conductive or catalytic metal, which is thought to serve as an activation catalyst.

These and other objects and features of the present invention will become apparent from the following description taken in conjunction with preferred embodiments thereof with reference to the accompanying drawings, in which.

Before the description of the present invention proceeds, it is to be noted that like parts are designated by like reference numerals throughout the accompanying drawings.

Figure 1:
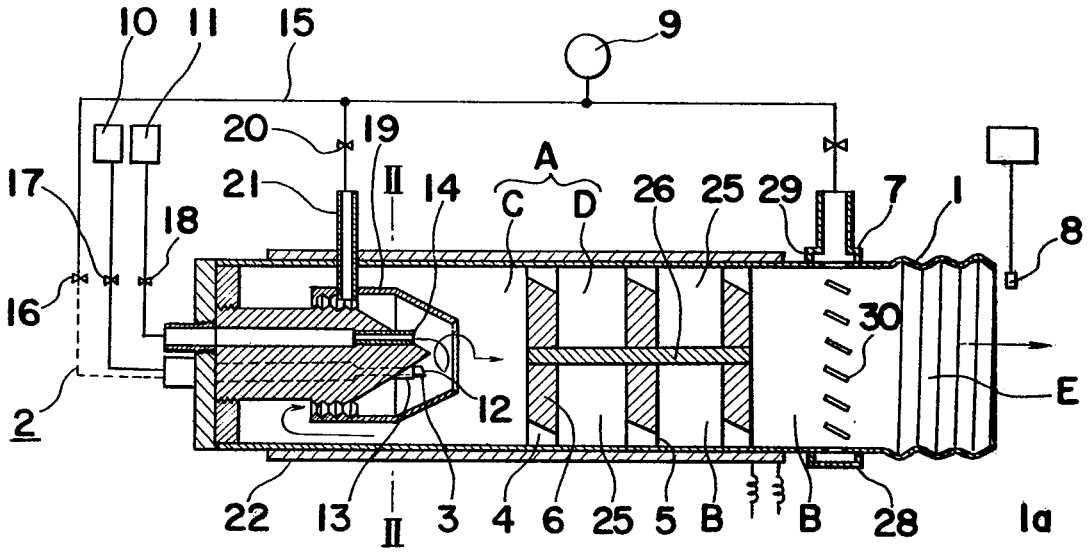
FIG. 1 is a schematic cross-sectional view of an embodiment of the apparatus for producing the gaseous fuel containing water according to the present invention.
Figure 2:
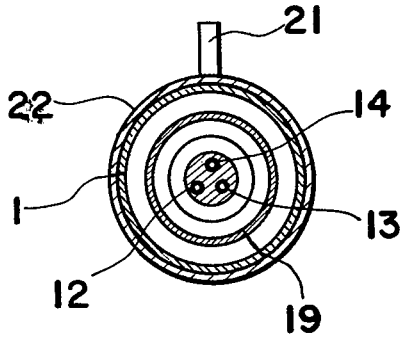
FIG. 2 is a cross-sectional view at the line II—II in FIG. 1.

Referring first to FIG. 1, there is shown a main part of the apparatus 1 having a mixing chamber A, wherein a gas mixture mainly exists, and a mixture gas chamber B, wherein the secondary-air exists. The mixing chamber A consists of a mist chamber C, wherein the mist exists, and a gas chamber D, wherein the vapor exists. The mist chamber C, the gas chamber D and the mixture gas chamber B compose a passage E, wherein the gas continuously can pass through, in this order. The main part of the apparatus 1 shown in FIG. 1 forms a cylinder with a bottom, which is made from a conductive or catalytic metal, is composed of said mist chamber C, the gas chamber D and the mixture gas chamber B, which form the continuous passage E in this order from the closed bottom end of the cylinder, and has an outlet 1*a* for the gaseous fuel containing water which is an open hole at the end of the mixture gas chamber B. The passage E formed in the cylinder of the main part of the apparatus 1 has advantageously a shape, for example, of a cylinder, wherein the gas flow can be swirled about the axis towards a certain direction, as well as the shape, for example, of a diverged frustrum of a cone, wherein the gas flowing from the mist chamber C to the mixture gas chamber B through the gas chamber D can be smoothly taken out from the outlet 1*a* to the outside. Besides, the chamber C, D and B have not to be divided definitely from each others, and the passage E cannot be specially limited as a rectilinear, curve-linear or mult-thread figure shape etc. in its shape or construction.

Figure 3:
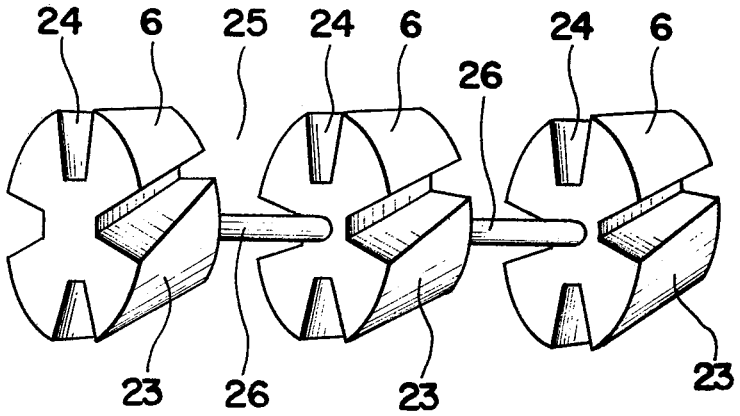
FIG. 3 is a diagonal view of a part of the apparatus in FIG. 1.
Figure 4:
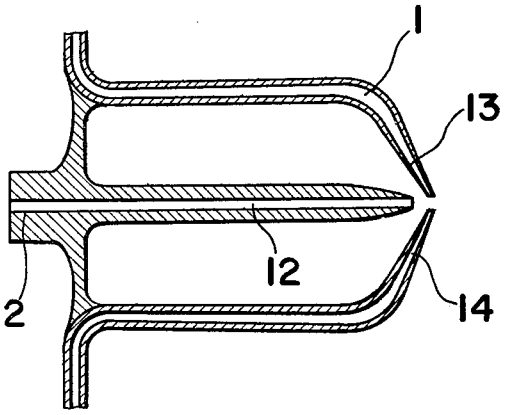
FIGS. 4 and 5 are respectively cross-sectional views of other embodiments of the primary-air supply device shown in FIG. 1.

The mist chamber C, having a means of spray 3 in it, is connected with a supply means for supplying materials 2 and a swirler 4, a means of increase and decrease in pressure 5, metallic elements 6 as activation catalysts and a means of heating 22 equipped in the gas chamber D, and the mixture gas chamber B is connected with a secondary-air supply device 7 and contains a means of ignition 8 near the outlet 1*a*. The material supply device 2 supplies the water, the fuel and the primary-air to the mist chamber. It does not matter whether these materials are supplied separately or in admixture, but it is necessary to control the conditions and the amount supplied. In FIG. 1, as a material supply device 2, an air pump 9, a water storage tank 10 and a fuel liquid storage tank 11 is equipped and also an air nozzle 12, a water nozzle 13 and a fuel nozzle, which are connected with the corresponding parts by means of pipe lines 15, respectively, are arranged in the mist chamber C. Each pipe line has a control valve 16, 17 or 18, respectively, to control the flow rate and the top of the air nozzle 12 is set near the back of the tops of the water nozzle 13 and the fuel nozzle 14. When the compressed air is supplied to the former nozzle 12 by working the air pump 9, the pressure near the tops of the latter nozzles 13, 14 becomes negative, then the water in the water storage tank 10 and the fuel in the fuel storage tank 11 are sucked out from the nozzles 13, 14, respectively, and the water and the fuel are sprayed out together to the mist chamber C and diffused in it. The above-mentioned three nozzles 12, 13 and 14 may be arranged separately as shown in FIG. 4, or formed as one-body of coaxial cylinders. In any case, it is preferred that the water and the fuel liquid are atomized as fine as possible by jets from the nozzles 12, 13 and 14 and the water, and the fuel liquid and further the primary-air are mixed to produce as homogeneous a mist as possible. The nozzles by themselves form the above-mentioned atomizing device 3. In addition to this, in the embodiment shown in FIG. 1, a diffuser hood 19 of roughly conical cylinder shape which encloses the above-mentioned nozzles 12, 13, 14, and additional primary-air from the air pump 9 is supplied to the said hood 19 through a supply pipe line 21 having a control valve 20. Accordingly, atomized mixture of the water, the fuel liquid and the primary-air jetted from the said nozzles 12, 13, 14 is further diffused along the hood 19 to a fine and homogeneous mist and is swirled towards one direction, and further diffused by the additional primary-air. When some of the mist jetted from the hood 19 through the nozzle is recirculated from the outside to the inside of the hood 19, the effect of diffusion can be increased. In this manner, the water and the fuel liquid are atomized, mixed with an amount of primary-air to form a mist and fed into the following gas chamber D by its injection force. Besides, if a means of heating 22 is set in the mist chamber C in order to vaporize the mist immediately, generation of the drain is avoided and the vaporization in the following gas chamber D is needless. In the gas chamber D, the means of heating 22 which heats the gas in this gas chamber up to the temperature about 100°-600° C., the swirler 4 which swirls the gas continuously as a swirl flow towards one direction, a means of repeating increase and decrease in pressure 5 which diffuses and compresses the gas, and moreover, the metallic element 6 which gives off the thermoelectrons to the gas and serves as an activation catalyst is present. In FIG. 1, the gas chamber is equipped with means of heating 22, which is an electric heater wound closely around the main part of the apparatus 1 which composes a surrounding wall of the gas chamber, and the gas in the gas chamber D is heated and the metallic element 6 is also heated up to such temperature that the activation easily occurs. The metallic element 6 is, as shown in FIG. 3, formed by several circular plates 23, dividing the gas chamber D, and a nozzle 24 is formed by several notches around the said circular plate 23. The above-mentioned swirler 4, which swirls the gas passing through the said nozzles towards one direction, is formed by tilting or curving the said nozzle 24 against the center of the circular plate, and moreover, the said means of increase and decrease in pressure 5 is so formed by wide spaces 25 between the said circular plates 23 that the compressed gas expands and diffuses through the said nozzles 24. When the said circular plates 23, which serve as activation catalysts, are penetrated by an axis 26 at the center and fixed thereto, the circular plates 23 are easily set in the main part of the apparatus 1. It is preferred that as an activation catalyst 6, the surface area of the circular plates 23 of the above-mentioned construction, including the surface area of the notches, is large, that the number of nozzles 24 is large and that the tilting or curving shape of them is so formed as the gas flow swirls violently when the circular plates 23 serve as the swirler 4, and that the circular plate 23 has such a shape that intensifies the effect of diffusion into the spaces 25 by the narrower cross-section of the nozzle 24 as a means of increase and decrease in pressure 5. The number of the circular plates 23 is required, to be at least, more than two in order to construct more than one space 25, and the larger the number is, the more intensive the above-mentioned processes of thermoelectrons release, swirl and increase or decrease in pressure become. If the number is too large, however, the pressure loss of the gas in the gas chamber D increased. The mist of the water, the fuel liquid and the primary-air in the gas chamber D from the mist chamber C is heated and vaporized by the heating means 22, kept at the temperature of about 100°-600° C., preferably 180°-300° C., swirled by means of swirler 4 towards one direction and compressed or expanded by the means of increase and decrease in pressure 5 with intense friction between them. Then thermoelectrons from the metallic element 6 is imparted to the gas in order to excite the gas molecules, and finally activated. As for the heating means 22, an electric heater, heat produced by the combustion of the gas, waste heat, electromagnetic wave energy or electron-beam energy may be utilized. As for the swirler 4, stirring plates which swirl the gas forcedly can be used in addition to guide plates or passages like the nozzles 24. As for the means of increasing or decreasing the pressure 5, a means of decreasing the pressure such as an orifice and a vane or a means of increasing the pressure such as a compressor, etc., in addition to the nozzles 24, may be used. As for the metallic element which serves as an activation catalyst, for example, a conductive or a catalytic metal, which is prone to take part in a hydration or partial-oxidation reaction with the hydro-carbon and generate the thermoelectrons, is suitable, and metallic materials such as Ni, Co, Fe, Cr, V, Pt, Pd, etc., or alloys including the above-mentioned metals, a simple substrate or a compound of the oxide of Ni, Co, Fe, Cr, V, Si, Mn, etc., or a mixture of the above-mentioned metals and their oxides may be utilized. An Ni-group metal is particularly preferable, and even stainless steel may satisfy the requirement. The metallic element may be formed by a catalytic column filled up by metallic particles or formed by porous plates arranged in the column, as shown in FIG. 1, to make up many chambers. As for the catalytic column, copper, steel or stainless steel, which serves as an activation catalyst by itself, is preferably used. The temperature of the catalytic column or the metallic element is about 100°-600° C., preferably about 200°-500° C.

Figure 6:
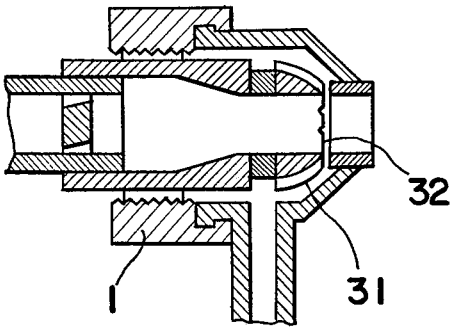
FIG. 6 is a cross-sectional view of another embodiment of the secondary-air supply device of FIG. 1.
Figure 5:
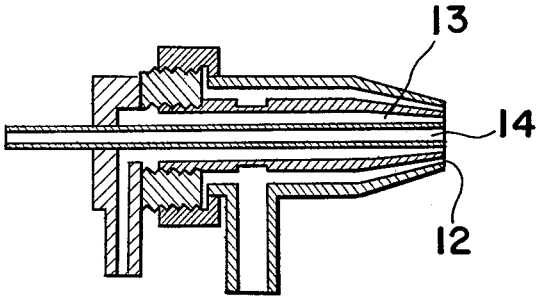
Figure 7:
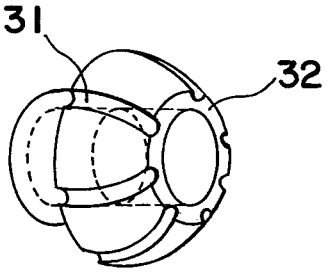
FIG. 7 is a diagonal view of a part of the device shown in FIG. 6.

As mentioned above, the water, the fuel liquid and the primary-air are subdivided into an activated vapor and, as a gaseous fuel containing water, is fed into the following mixture gas chamber B by the swirling force itself. In the mixture gas chamber B, the secondary-air required to burn the said gaseous fuel containing water is supplied by means of supply 7, and the gases mixed. In the embodiment of FIG. 1, the secondary-air is led from the supply pump 9 of the said primary-air through the pipe line 15 having a control valve 27 to a distributor 28 and is supplied to the mixture gas chamber B. The distributor 28 leads the secondary-air from the surrounding surface to the main part of the apparatus, which forms the outside wall of the mixture gas chamber B, almost uniformly to the mixture gas chamber with a constant angle of inclination, correspondingly, and swirls the said gaseous fuel containing water together with the secondary-air, so as to mix them homogeneously and force the gas out of the outlet 19. The distributor 28, as shown in FIG. 1, may be composed of a lead pipe 29 almost surrounding the outside wall of the main part of the apparatus and lead holes 30 which are opened at the inside wall of the main part of the apparatus 1 for the connection of the lead pipe 29 with the inside of the mixture gas chamber or, as shown in FIG. 6, may be composed of the above-mentioned lead groove 31 and a notch 32 which is formed in the wall of the main part of the apparatus for the connection of the lead pipe with the inside of the mixture gas chamber. It is preferred that the swirl flow of the gas from the distributor 28, be changed continuously to the swirl flow in the above-mentioned gas chamber D. It is not preferable that the swirl flow of the said gaseous fuel containing water be reversed from the mixture gas chamber B to the gas chamber D by the introduction of the secondary-air into the mixture gas chamber B by the distributor, but it is preferably that the said gaseous fuel containing water is sucked from the gas chamber D into the mixture gas chamber B by the secondary-air. Thus, the mixture of the gaseous fuel containing water and the secondary-air from the outlet 19 of the mixture as chamber B is ignited by a means of ignition 8 and burned.

In order to produce the gaseous fuel containing water by the apparatus having the above-mentioned structure, the air supply pump 9 is worked, the water and the fuel liquid are supplied from the water storage tank 10 and the fuel storage tank 11, respectively, the means of heating 22 is operated. Then, the water and the fuel liquid, which is supplied by the material supply device 22 to the mist chamber C of the main part of the apparatus 1, is atomized by the atomizer 3 in the presence of the primary-air, which is fed, for example, at the pressure 1-10 kg/cm$^2$ and flow rate 500-1000 cc/min. The mixing ratio of the water to fuel liquid is about 10/90-60/40 in volume ratio, preferably 20/80-50/50, and the mixing ratio of the primary-air to the fuel is not limited, depends on the amount of fuel liquid and water supplied and the combustion velocity, etc., but is preferably about 10-30 in gas volume ratio. The above-mentioned mist is led to the gas chamber, vaporized by the means of heating 22 up to the temperature about 100°-600° C., preferably 180°-300° C., swirled violently by the swirler 4, repeatedly expanded and compressed by the means of increase and decrease in pressure 5 with intense friction between the molecules of the gas, and simultaneously receives the thermoelectrons from the heated metallic element and is activated. Then, the gaseous mixture is led into the mixture gas chamber as a gaseous fuel containing water which resembles the products of reaction of the components, and consequently mixed with the secondary-air, as required for combustion, and then burned. It is preferred that the amount of secondary-air supplied is, in the mixing ratio to that of the fuel liquid, of about 20-60 in gas volume ratio and is greater than that of pure fuel combustion by 10%. Thus, when the gaseous fuel containing water is burned with the secondary-air, a flame of a colza-color extremely beautiful to the eye is formed. The temperature of the flame is much higher than that of the pure fuel combustion and the volume of the flame is larger, whereas the concentration of $NO_x$ and CO of the waste gas is remarkably less than that of pure fuel combustion. Moreover, the temperature of the waste gas is the same or higher than that of pure fuel combustion, and the humidity of the waste gas is the same or less.

The following, experimental data are shown to compare the energy produced by the combustion of the gaseous fuel containing water composed of the water, the fuel liquid and the air in the above-mentioned apparatus, with energy produced by the combustion of pure fuel.

EXPERIMENTAL EXAMPLE 1

The specification of the apparatus used in this experiment is as follows:

An atomizer nozzle as shown in FIG. 1, a catalyst bed in FIG. 3 and a burner in FIG. 6 are used. The catalyst bed or column is constructed by 8 stainless steel circular plates of 14 mm diameter and 10 mm thickness which are arranged at equal distances from each other. The inner diameter of the column is 14 mm and the length is 750 mm. The above-mentioned construction is for one unit and 3 units are arranged in a series in the apparatus. The diameter of the burner head is 20 mm.

A propane-gas burner is used for a means of heating.

Figure 13:
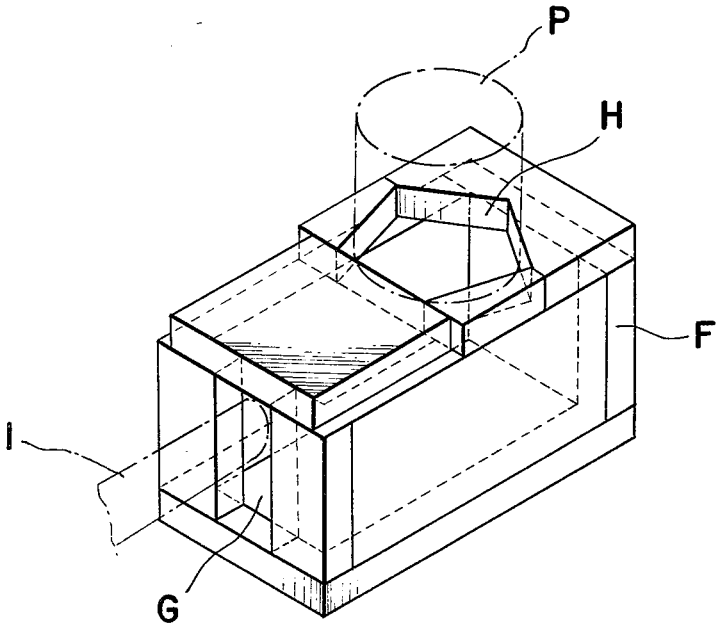
FIG. 13 is a diagonal view of the furnace for measuring the thermal efficiency.

An apparatus for the measurement of thermal efficiency consists of a furnace G, the inner dimension of which is 46 (length$\times$20 (width)$\times$28 (height) cm$^3$, made of 5 cm thick firebricks as shown in FIG. 13, having a burner hole F (10$\times$23 cm$^2$) at one end and a pentagonal hole H of about 15.5 cm sides, one of which is located at 25 cm at the shortest from the burner hole F of the furnace G, at the top.

The combustion apparatus by this invention of the above-mentioned specification is connected with the said apparatus for the measurement of thermal efficiency and a MILLION pot P of 20.5 cm diameter and 21.8 cm height, containing water, is inserted in the upper hole H.

After the burner is ignited, water in the MILLION pot P is heated, and the heat balance is calculated from the fuel consumption and the temperature rise of the water.

Instead of the burner used in this invention, a burner for a hot-water boiler on the market (NORITSU instantaneous hot-water boiler (OQ-23): made by NORITSU Co., Ltd.) is used and the heat balance is compared with the above results.

The experimental conditions are shown in Tab. 1 and comparison between the data of the combustion of a kerosene-water mixture and that of a pure kerosene combustion is shown in Tab. 6.

TABLE 1

| | Experimental conditions | |
|---|---|---|
| 1 | Room temperature | 14° C. ± 2 |
| 2 | Initial temperature of water | 15° C. ± 1 |
| 3 | Container for heating of water | 205 diameter × 218 height MILLION pot |
| 4 | Amount of water used | 6l |
| 5 | Burner nozzle diameter | 20 mm I.D. × 3 |
| 6 | Inside dimension of furnace | 200 width × 460 length × 230 height = 0.02116 $m^3$; firebrick made |
| 7 | Temperature of heating apparatus | 200°-400° C. |
| 8 | Measurement time | about 6 min 50 sec ± 5 |
| 9 | Distance between burner and heater | 250 mm |
| 10 | Measurement of fuel consumption | Measurement of amount of remain by burette method |
| 11 | Amount of LP-gas used for preheating apparatus | 19320 ml |

TABLE 2

Data of combustion of kerosene-water mixture
Amount of water used for measurement of heat is 6000 cc

| Kerosene used | Water used | Total calorific value | Heat absorbed by water | Temperature of waste gas | Measurement range |
|---|---|---|---|---|---|
| 275 cc | 97 cc | 2365000 cal (kerosene only) | 486000 cal | average 635.3° C. | 13°-96° C. |

The amount of LP-gas used for heating the apparatus 700 cc per min × 6 min 54 sec = about 4830 cc total calorific value 115,920 cal + 347,760 = 463,680 cal (where, in practice, efficiency is about 50% (½))

TABLE 3

Waste gas measurement
data of combustion of kerosene-water mixture
water 26% + fuel oil 74% + air

| Classification | Amount of gas | Concentration | Difference by comparison |
|---|---|---|---|
| $NO_x$ | 10 l | 10-20 PPM | -40~-30 PPM |
| HC | 10 l | 1.27 PPM | +1.133 PPM |
| CO | 10 l | 0.15 % | -1.35 % |

TABLE 4

Data of pure kerosene combustion
Amount of water used for measurement of heat is 6000 cc

| Kerosene used | Total calorific value | Heat absorbed by water | Temperature of waste gas | Measurement range |
|---|---|---|---|---|
| 370 cc | 3182000 cal | 480000 cal (except for latent heat) | average 615.7° C. | 16-96° C. |

TABLE 5

Waste gas measurement data of pure kerosene combustion
kerosene + air

| Classification | Amount of gas | Concentration |
|---|---|---|
| $NO_x$ | 10 l | 50 PPM |
| HC | 10 l | 0.137PPM |
| CO | 10 l | 1.5 % |

Apparatus for measurement

| | |
|---|---|
| Automatic measuring apparatus of $NO_x$ | ECL - 77A |
| Hydro-carbon measuring apparatus | HC analyzer EIR - 2045 |
| Carbonmonoxide measuring apparatus | CO analyzer EIR - 2015 |

TABLE 6

Comparison of data

| Amount of kerosene saved | Total calorific value | Efficiency of heat absorbtion | Temperature of waste gas |
|---|---|---|---|
| 95 cc | 817000 cal | 6% improved | 19.6° C. higher |

Net heat balance 817,000 cal − 463,680 cal (used for heating the apparatus) = more than 353,320 cal is energy produced when the water is used as a fuel, where a small amont of HC is exhausted due to the lack of air.

From the above-mentioned heat balance, it is clear that the ratio of the combustion efficiency according to the method of this invention to that of pure kerosene combustion is about 114% (17.2/15.1).

In this experimental example, heating of the apparatus is done by the combustion of propane-gas under such conditions as being open to the air and wherein only a part of energy is utilized. If the heating is performed more effectively, thermal efficiency may be improved. The temperature of the waste gas is higher than that of pure kerosene combustion. Thermal efficiency may also be improved if the waste gas is utilized for heating the combustion apparatus.

Figure 8:
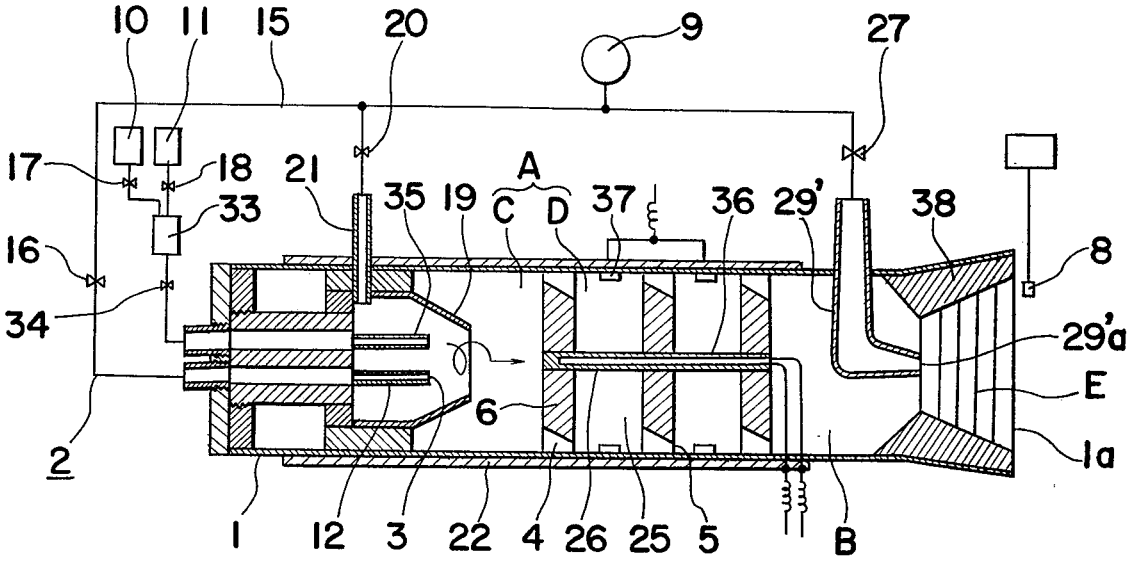
FIG. 8 is a schematic cross-sectional view of another embodiment of the apparatus for producing the gaseous fuel containing water according to the present invention.
Figure 9:
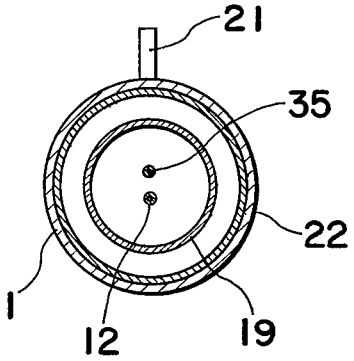
FIG. 9 is a cross-sectional view at the line IX—IX in FIG. 8.
Figure 10:
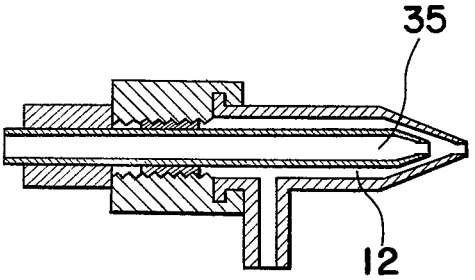
FIG. 10 is a cross-sectional view of another embodiment of the primary-air supply device in FIG. 8.

In FIG. 8, another embodiment of the apparatus of the present invention is shown. This apparatus is different than the apparatus in FIG. 1 in that a mixing chamber 33 for the water and the fuel liquid is equipped to the material supply device 2; a mixture of the water and the fuel liquid, mixed in the mixing chamber, is supplied to the mist chamber C through a control valve by a mixture nozzle 35; an auxiliary heating device 36 is set in the support axis 26 of the metallic element 6 in the gas chamber D; and an assistant activation device 37 consisted of an electron-beam generator in the space 25 of the gas chamber D. Moreover, another difference is that a lead pipe 29' to convey the secondary-air, whose open end 29'a is placed opposite to the outlet 1a of the main part of the apparatus, is set at the center of the mixture gas chamber as a means of supplying the secondary-air and further a trumpet-shaped guide wall 38 diverged opposite to the outlet 1a is formed in the inside wall of the main part of the apparatus 1. The mixture nozzle 35 which supplies the the mixture in the said mixing chamber may be formed, as shown in FIG. 10, as a coaxial cylinder with the air nozzle 12. By mixing and emulsifying, previously, the water supplied from the water storage tank 10 and the fuel liquid from the fuel storage tank 11, the flow rates controlled by the control valves 17, 18 of the material supply device 2, the fuel combustion can be mixed and atomized uniformly, smoothly and effectively, and the emulsion can be easily and reliably jetted into the mist chamber C. The auxiliary heating device 36 and the assistant activation device 37 set in the gas chamber D are useful to smoothly accelerate the production of the gaseous fuel containing water and to improve the quality of the fuel. Further, an open hole 29'a of the secondary-air lead pipe 29' in the center of the mixture gas chamber B is useful to mix the gaseous fuel containing water and the secondary-air smoothly and effectively, and therefore, to burn with high efficiency the gaseous fuel containing water.

Figure 11:
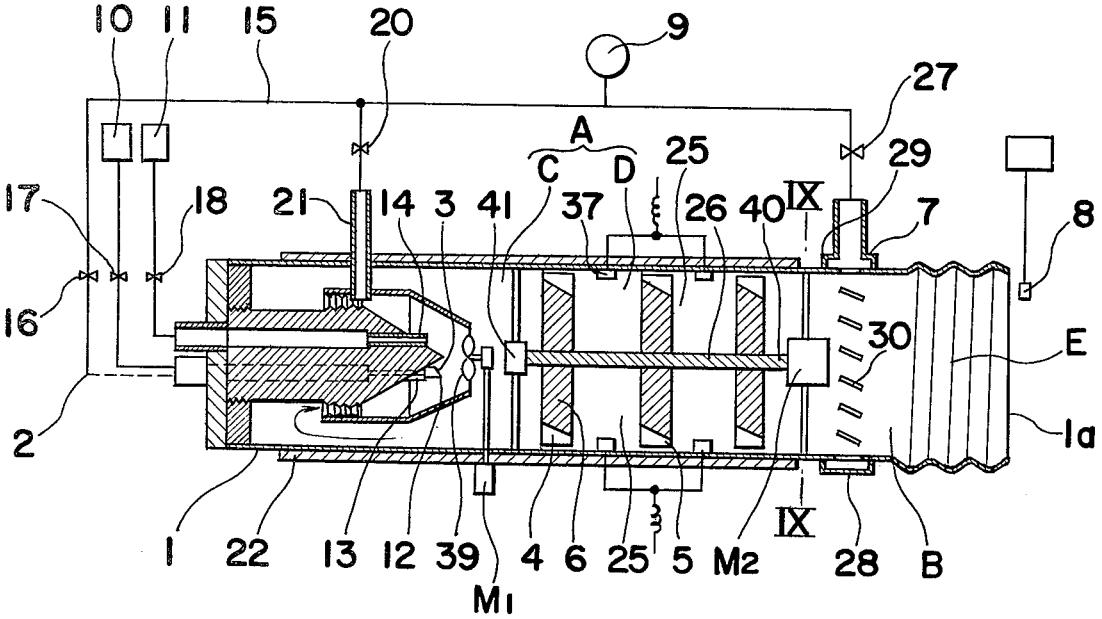
FIG. 11 is a schematic cross-sectional view of another embodiment of the apparatus for producing the gaseous fuel containing water according to the present invention.
Figure 12:
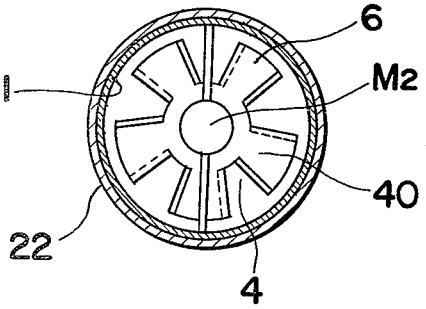
FIG. 12 is a cross-sectional view at the line C—C in FIG. 11.

FIG. 11 shows another example of an embodiment of the apparatus according to this invention, and it differs from the apparatus in FIG. 1 in the points that a means 39 consisting of a blade is used which stirrs the mist forcedly in the mist chamber C and in the use of a driving motor $M_1$. Further, the apparatus contains a means 40 consisted of a bearing 41, which supports the axis 26 of the circular plates in order to turn it towards one direction in the gas chamber D, and a driving motor $M_2$ for the axis 26 is employed which makes the circular plates 23 work as a kind of blade. Thus, when the mist in the mist chamber C is stirred by the stirring device 39, it can be vaporized easily and smoothly, and when the vapor in the gas chamber D is forcedly blown out with stirring towards one direction by the circular plates 23 of the turning device 40 which serve as blades, the friction motion between the molecules of the vapor is so intensified that the reaction occurs smoothly and rapidly, and consequently, the gaseous fuel containing water can be produced smoothly, rapidly and effectively. Therefore, efficiency and quality of the fuel is increased.

As described above, this invention, in short, is concerned with regenerating water as a kind of fuel in the presence of a conventional fuel and air, and the gaseous fuel containing water is, a highly calorific and unpollutive fuel. The process for producing the gaseous fuel containing water by this invention enables one to produce it easily and effectively by swirling the mixture gas and contacting it with the heated metallic element. Moreover, the apparatus for producing the gaseous fuel containing water by this invention is such as to produce the gaseous fuel containing water with ease and also inexpensively the simple structure of the means for producing the mixture gas, the swirler and the reaction passage having the heated metallic element.

This invention can be embodied in various forms within the limits of the essence of the claims and, as a matter of course, any embodiment which accomplishes the aforementioned results falls within the ambit of the invention.

What is claimed is:

1. An apparatus for producing a gaseous fuel containing water, said apparatus being in the form of a cylinder comprising a supply end for introducing air, liquid fuel and water, and at the other end an open outlet for transferring exhaust gases out of the cylinder; means for swirling the gaseous flow around an axis centrally located within the cylinder; a pump connected to the cylinder for supplying primary compressed air into the supply end of the cylinder; at least one supply device comprising a nozzle means for injecting and atomizing water and said liquid fuel individually or in admixture into the cylinder by means of the primary compressed air; means for heating the gaseous mixture in said cylinder; means for repeatedly increasing and decreasing the pressure within the cylinder of the swirling gaseous mixture, which pressure variation is effected by vaporizing the water and liquid fuel or mixtures thereof by means of the primary air flow along the axis of the cylinder, said pressure increasing or decreasing means comprising more than two nozzles for controlling the pressure; metallic elements located within the cylinder for contacting the gaseous mixture so as to cause the gaseous water, fuel and air mixture to react with each other; means of supplying secondary compressed air to the outlet of the cylinder wherein the secondary air mixes with the gaseous mixture of primary air, fuel and water in said cylinder and which secondary air is introduced within the cylinder in an amount sufficient to forcibly blow said gaseous mixture out of the outlet; said cylinder containing ignition means near the outlet of the cylinder for igniting the mixture of the reactive gases and secondary air.

2. An apparatus according to claim 1 wherein the mixture of supply gases is swirled through a reaction passage located within the cylinder in one direction towards the outlet with such force as to generate intense friction between the gases, and wherein the heating means is capable of heating the gaseous mixture within said passage at temperatures of about 100°-600° C. and also to heat the metallic elements contacting said heated gaseous mixture so that the heated metallic elements impart thermoelectrons to the gaseous mixture in the reaction passage.

3. An apparatus according to claim 2 wherein the metallic elements are activation catalysts which activate the gaseous mixture and accelerate the reaction between the components of the gaseous mixture by imparting thermoelectrons to the mixture.

* * * * *